US005572429A

United States Patent [19]

Hunter et al.

[11] Patent Number: 5,572,429

[45] Date of Patent: Nov. 5, 1996

[54] SYSTEM FOR RECORDING THE INITIALIZATION AND RE-INITIALIZATION OF AN ELECTRONIC POSTAGE METER

[76] Inventors: Kevin D. Hunter, 440 Allyndale Dr., Stratford, Conn. 06851; Perry A. Pierce, 11 Raymond Heights, Darien, Conn. 06820; Iiya Shnayder, 7 Rockmere Rd., Apt. 2, Norwalk, Conn. 06851

[21] Appl. No.: 349,576

[22] Filed: Dec. 5, 1994

[51] Int. Cl.[6] ..... G07B 17/02

[52] U.S. Cl. ..... 364/464.02; 364/286.5; 364/969.4; 364/DIG. 1; 364/DIG. 2

[58] Field of Search ..... 340/825.32; 364/406, 364/464.02, 286.5, 969.4; 380/3; 395/490.726

[56] References Cited

U.S. PATENT DOCUMENTS

| | | | |
|---|---|---|---|
| 3,792,446 | 2/1974 | McFiggins et al. | 364/464.02 |
| 4,783,745 | 11/1988 | Brookner et al. | 364/464.02 |
| 4,812,994 | 3/1989 | Taylor et al. | 364/464.02 |
| 4,914,606 | 4/1990 | Vermesse | 364/464.02 X |
| 4,931,943 | 6/1990 | Vermesse | 364/464.02 |
| 4,962,454 | 10/1990 | Sansone et al. | 364/464.02 |
| 5,077,792 | 12/1991 | Herring | 380/24 |
| 5,107,455 | 4/1992 | Haines et al. | 395/275 |
| 5,377,264 | 12/1994 | Lee et al. | 380/4 |
| 5,490,077 | 2/1996 | Freytag | 364/464.02 |

FOREIGN PATENT DOCUMENTS 2 251 210 7/1992 United Kingdom .

*Primary Examiner*—Edward R. Cosimano

*Attorney, Agent, or Firm*—Lawrence E. Sklar; Melvin J. Scolnick

[57] ABSTRACT

An improved electronic meter for accounting for funding and transaction information includes a micro control system for controlling the operation of the meter in response to an operation program. The micro control system utilizes a microprocessor in bus communication with a plurality of addressable memory units and input device in bus communication with the microprocessor. The meter has a first mode of operation for performing transactions and accounting for the transactions and a second mode of operation for accessing the accounting information in response to a first security code. At least one of the memory units has a plurality of accounting registers for storing the accounting information in predetermined categories. The meter has a third mode of operation for accessing the registers of the first memory and initializing the registers in response to the input of a second security code. The accounting information including a REINIT table for creating a selected number of records representative of the accounting information of the accounting register in the respective categories upon each initialization of the accounting registers. The operation program prevents the record from being overwritten once the respective record has been created and the meter is in the first, second or third mode.

6 Claims, 3 Drawing Sheets

SYSTEM FOR RECORDING THE INITIALIZATION AND RE-INITIALIZATION OF AN ELECTRONIC POSTAGE METER

BACKGROUND OF THE INVENTION

The present invention relates to an electronic postage meter system and, more particularly, to the process of re-initialization of an electronic postage meter system.

In a conventional electronic postage meter, it is known to provide the postage meter with a microprocessor control system mounted in a secure housing. The microprocessor control system includes a microprocessor, read only program memory and one or more secure non-volatile memories. The non-volatile memories are customarily protected from access by the user through the user interface of the meter or by an external communication device. The meter accounting and funding information is stored in the secure non-volatile memories which is sometimes referred to, in combination with the memory security circuit, as the meter vault. The information customarily stored in the vault is the ascending registers, which provides a historical record of all postage dispensed by the postage meter since the meter was placed in service, descending registers, which account for postage funds available for posting by the meter, a control sum which when combined with the ascending register and descending register reading provide register reconciliation, and a piece count register. Additionally, each meter serial number is stored in the secured memory. Specifically, the descending register can be accessed by the meter user for recharge only after receiving an authorization code from the manufacturer's data center. A known process for remotely resetting the meter descending registers is described in U.S. Pat. No. 3,792,446, entitled Remote Postage Meter Resetting Method, issued to McFiggans et. al. As an additional security measure, the meter control system is housed in a secure housing employing tamper detection, such as, brake off screws, etc., which provide visual evidence if an attempt has been made to gain unauthorized access to the control system.

It has been empirically experienced that due to anomalies common to micro control systems or operator error, that a meter is reported inoperable and taken out of service, when in fact, the meter is fully functionable. In order to evaluate the meter's operability, once the meter is taken out of service, it is presently necessary in many instances for the manufacturer's service center to remove the meter cover to gain access to the meter's control system and apply intrusive procedures in order to circumvent the meter's internal vault security. Additionally, it is necessary for the service center to access the vault in order to retrieve the fund resident in the meter secure memory in order to credit the customer or user's account. Also, it is necessary to access the vault of operable but returned rental meters so that the accounting registers and other internal systems may be reinitialized in preparation for re-deployment of the meter.

It has been empirically experienced that often the service center determines that the returned meter is not defective. As a result, considerable unnecessary expense has been incurred in taking the meter out of customer service and transporting the meter to the service center. Additional expense has been incurred in removing the secure meter housing in order to check the control system since removal of the secure meter housing is destructive to the housing. With respect to rental return meter, again, additional expense is incurred in removing the secure housing in order to reinitialize the control system.

SUMMARY OF THE INVENTION

It is an objective of the present invention to present a method and apparatus for unlocking and permitting access to the meter serial number without intrusion within the secure meter housing while maintaining system security.

It is a further objective of the present invention to present a method and apparatus for providing an audit trail that permits a record of unauthorized access to the meter.

It is a still further objective of the present invention to present a method and apparatus for preventing re-initialization of the meter more than a preset number of times.

It is a yet further objective of the present invention to present an apparatus and method for allowing the meter to have its registers returned to zero while unlocked, but doing this in a manner which permits the historical postage consumed to be determined at a later date.

The postage meter includes a microprocessor based control system housed within a secure housing. The microprocessor control system is comprised of a programmable microprocessor in bus communication with a plurality of memories and an application specific integrated circuit (ASIC). At least one of the memories is non-volatile memory to which access is restricted in accordance with a security program in combination with a memory security module of the ASIC. The security module and micro control system programming restricts writing to or reading from the registers of the nonvolatile secure memory except upon specific occurrences. One such occurrence is during the manufacturing process at which time the meter serial number is written and locked to a specific address location in the secure memory, during posting of postage dispensed by the meter and during meter recharge. Use of the term "locked" refers to the process of setting a flag which when set prevents the microprocessor from accessing an associated address location in a memory.

Maintained redundantly in the secure memory is an internal table referred to as the "REINIT table". When the meter is first assembled, the secure memory area associated with the respective REINIT tables, preferably in separate secure non-volatile memories, will not have been initialized. As a result, all the entries in the table will either (a) have an invalid CRC (Cycle Redundancy Check) or (b) have an improper "Magic Number" constant or both. The Magic Number is a discrete multi-byte number utilized in calculating the CRC to further reduce the chance of a random false positive in the CRC. If neither the CRC or Magic Number check in the respective REINIT tables, then the meter will conclude that it has never been initialized i.e., by observing that all the entries in both tables are invalid.

When the very first initialization of the secure memory is performed on the meter, the meter will sequentially perform: (1) set all the first record header entries in the REINIT table to the "Empty" state; (2) initialize all other areas of the secure memory other than the REINIT tables to appropriate initial values; and (3) overwrite the record header in the first REINIT table record to the "Cold Init" state. Following this, the meter is now in the generic meter state and is unlocked (i.e., manufacturing mode). The next step is to parameterize the meter and lock the memories. If, prior to the lock operation, the registers were set to a value other than that normally associated with the locking process, for example, during meter duplication, a "Register Set" entry is made in the record header of that record in the REINIT table. The data entries for the record now being created are the date and time of data entries, ascending register value, descending register value, piece count, universal piece count and a Delta ascending register value, i.e., the difference between the pre-existing ascending register value and the new value to which the ascending register is being set to.

If a second or subsequent Register Set operation takes place, set values will be overwritten within a new record. In this case, however, a Delta AR entry is updated, rather than overwritten, so that the new entry correctly reflects the change in the ascending registers since the cold entry or previous unlock operation. When the meter is locked, the record header overwrites the Register Set entry to a lock header. A new record contains the new appropriate ascending register (AR) value, change in the ascending register value (Delta AR), descending register (DR) value, Piece Count (PC) and piece count offset value (PC offset). The PC offset value is calculated to yield the correct piece count based on the current universal PC (UPC), which represents the number of trip operations which have taken place after the meter was last initialized.

Each record contains the register setting at the time of the unlock operation. This provides a permanent record from which the register values at the time of each Unlock operation. Only a fixed number of records are permitted to be made in the REINIT table. As a result, the opportunity for "burnout backup" will not be presented. Should either of the secure memories develop a random byte failure in this area, as evidenced by a write failure, the meter will fatal. In order to access the REINIT table subsequent to the manufacture of the meter, an access combination must be obtained from the manufacturer. As a result, the manufacturer has a record of all authorized entries into the REINIT table which can be used to verify the REINIT table records if fraud is suspected.

DETAILED DESCRIPTION OF THE PREFERRED EMBODIMENT

Figure 1:
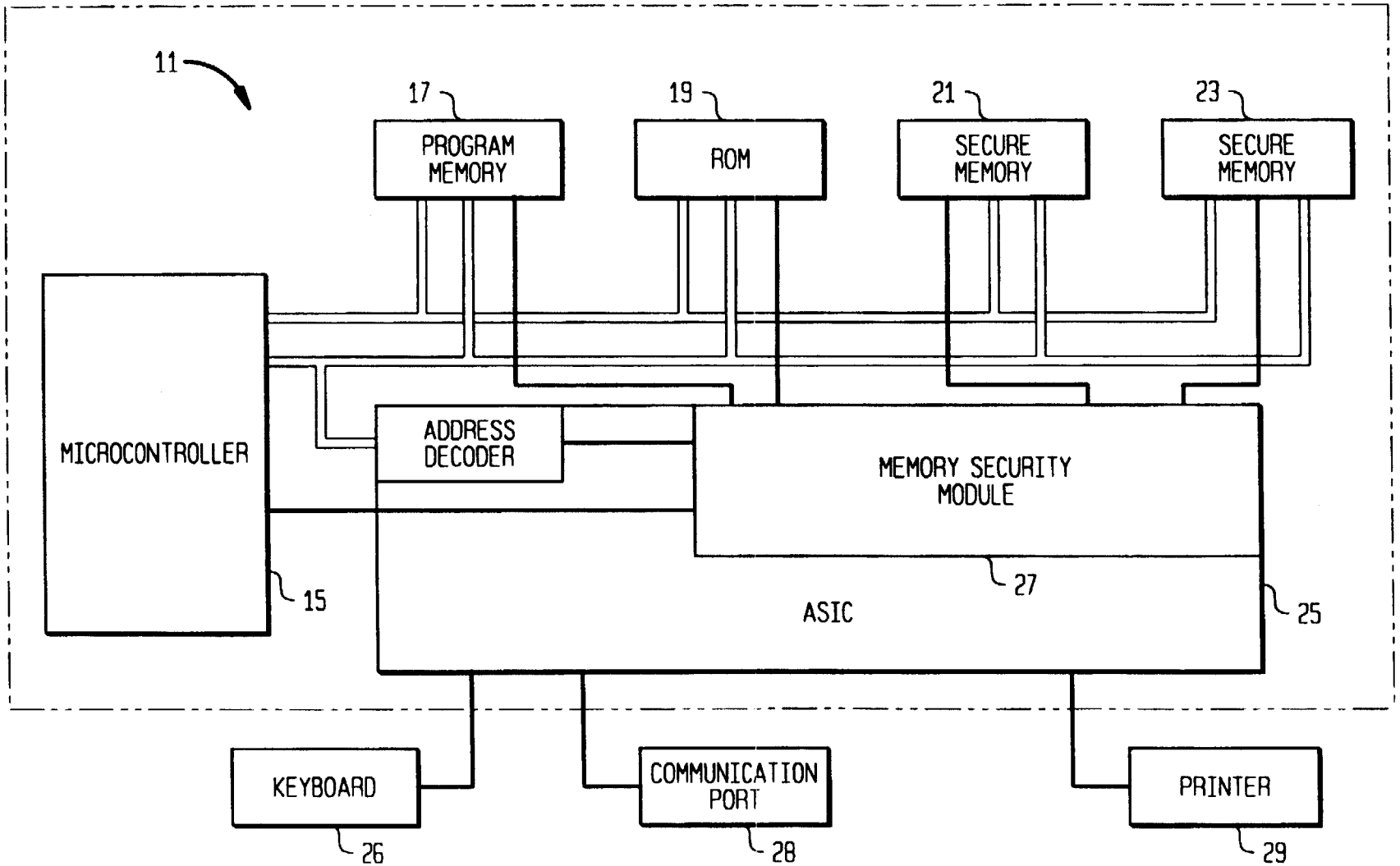
FIG. 1 is a schematic representation of a micro control system in accordance with the present invention.

The postage meter (not shown) includes a microprocessor based control system 11 housed within a secure housing. The microprocessor control system 11 is comprised of a programmable microprocessor 15 in bus communication with a plurality of memory units 17, 19, 21 and 23 and an application specific integrated circuit (ASIC) 25. The secure memories 21 and 23 are preferably non-volatile memories. Also, in bus communication with the ASIC 25, are a keyboard 26, a communication port 28 and a digital printer 29. Access to the non-volatile memories, as well as the program memory 17 and working memory 19, are restricted in accordance with the state logic of security module 27 of the ASIC 25. Of specific interest, the security module 27 in combination with the control system programming prevents writing to or reading from the registers of the secure memories 21 and 23 except upon specific occurrences. One such occurrence is during the manufacturing process at which time the meter serial number is written and locked to a specific address location in the meter, during posting of postage dispensed by the meter and during meter recharge. A more detailed description of the state logic of the meter security module 27 is presented in U.S. patent application Ser. No. 08/163,774 entitled "Memory Access Protection Circuit With Encryption Key" and new U.S. Pat. No. 5,377,264 and U.S. patent application Ser. No. 08/163,811 entitled "Memory Monitoring Circuit For Detecting Unauthorized Memory Access", both here incorporated by reference.

Figure 2:
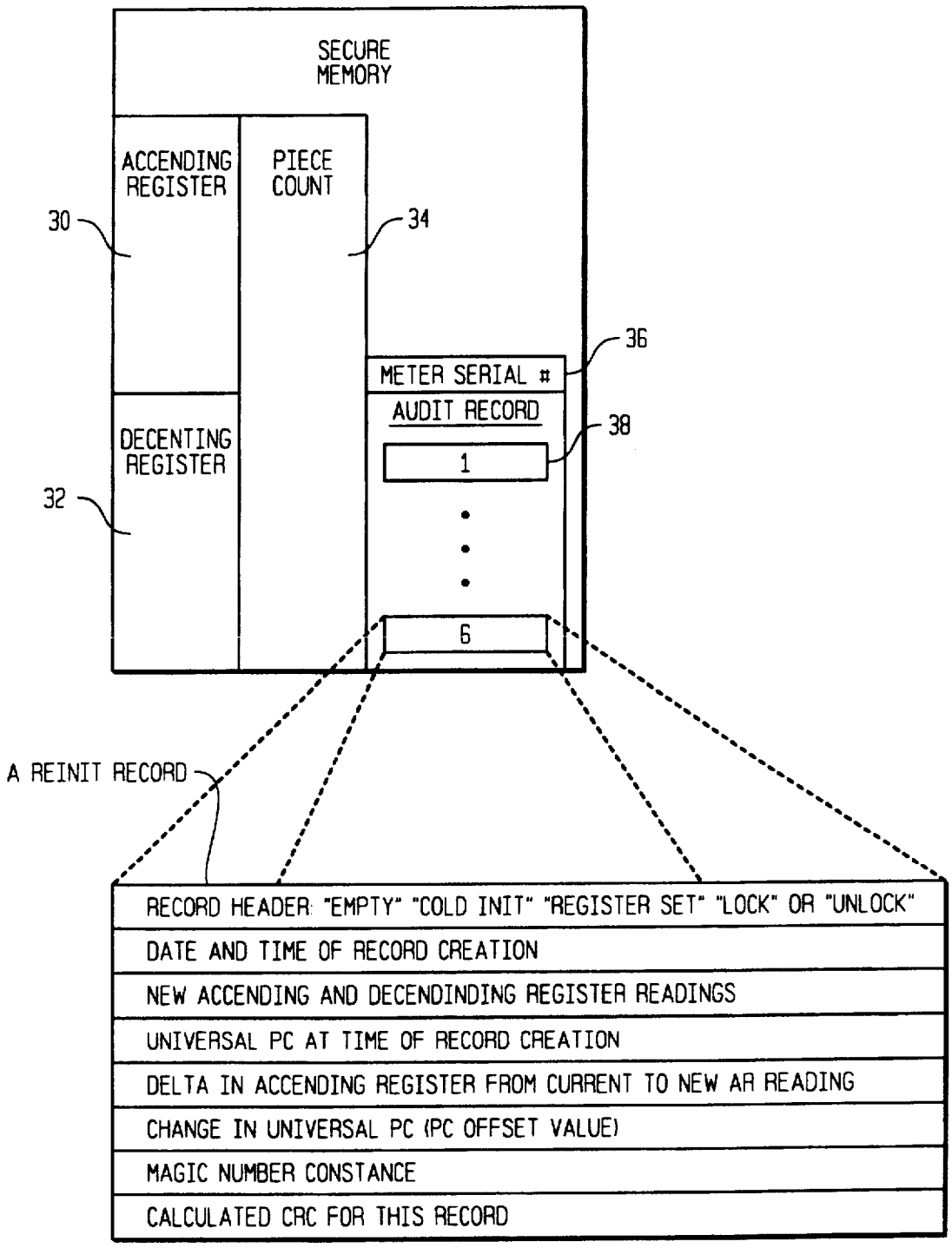
FIG. 2 is a schematic representation of a secure memory map in accordance with the present invention.

Referring to FIG. 2, each of the secure memory units 21 and 23 are mapped to have an ascending register addressable area 30, a descending register addressable area 32 and a piece count register addressable area 34. Also stored in a locked address area 36 is a table referred to as the REINIT table 38. Each table 38 record 1–6 will preferably having a record header which is one of the following: "Empty", "Cold Init", "Register Set", "Lock", or "Unlock". The record entries are: Date and time of REINIT try; AR value to which the AR register is set by this reset operation; DR to which the DC register is being set by this reset operation; Universal PC value at time this record is created; Delta AR since previous reset operation; and CRC for the entire record. Also, recorded in the current record is a PC offset value which is used to convert UPC into "external" PC and a "Magic Number" constant. The use of the Magic Number constant is intended to help prevent the 1-in-256 chance that the (random) CRC byte might match the random data. By using a multi-byte Magic Number as part of the record, and by choosing the Magic Number to be a value unlikely to appear in a random memory, the odds that a truly randomized entry will be erroneously seen as valid can be made as small as desired.

Figure 3:
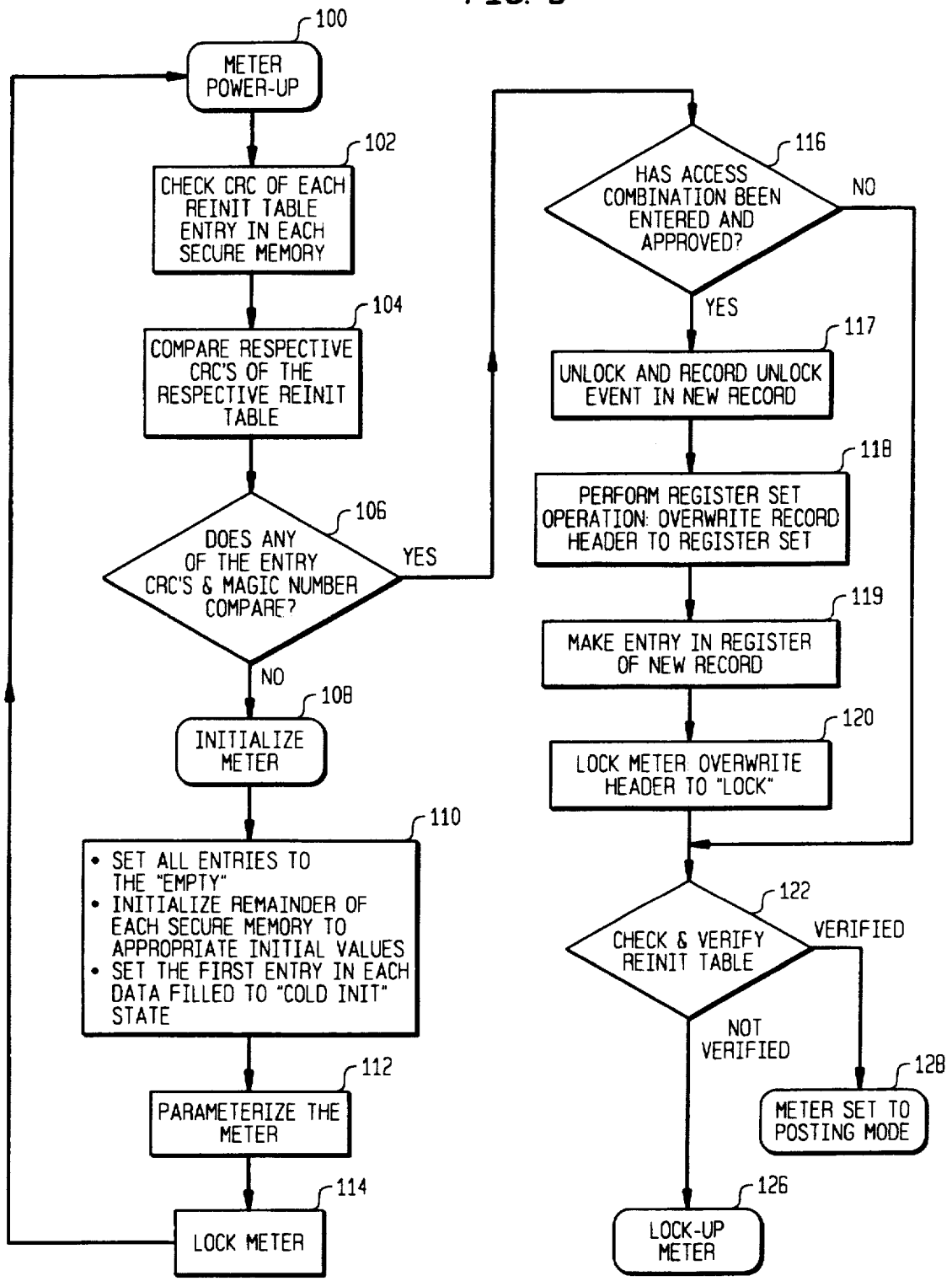
FIG. 3 is a logic chart for the access procedure to the REINIT of the secure memories in accordance with the present invention.

Referring to FIG. 3, when the meter is first assembled, the secure memory address area associated with REINIT table 38 will not have been initialized. As a result, all the entries in the table will either have an invalid CRC or have an improper "Magic number" constant or both. In this manner, the meter will determine that it has never been initialized by observing that all the entries in both tables are invalid. Specifically, upon meter power-up at logic setup 100, a check is performed at logic step 102. This check involves determining the CRC for the record and retrieving the Magic Number associated with the REINIT table 38 in each of the secure memories 21 and 23. A comparison is then performed between the respective CRC's and Magic Number of the respective REINIT table at logic step 104. If, at logic step 106, none of the entries match, then the meter is ready for a first initialization at logic step 108.

Then the very first initialize operation of the secure memories 21 and 23 is performed, at logic step 110; all the record headers and entries in the REINIT table are set to the "Empty" state; the remaining memory area, other than the REINIT tables is initialized to appropriate initial values; and the record header of the first record in the REINIT table is set to the "Cold Init" state.

Following this, the meter is now in the "Generic Meter" state, and is unlocked (in manufacturing mode). The next step is to parameterize the meter, at logic step 112, and then lock the meter, at logic step 114. The meter, following this operation, will return to the meter power-up at logic step 100. If, at logic step 106, prior to the lock operation, the registers were set to a value other than that normally associated with the locking process, for example, during meter duplication then at logic step 116, a test is performed to determine whether an access combination has been entered and verified. If, at logic step 116, a combination has not been entered and verified, then the meter performs a check and verification between the respective REINIT table at logic step 122. If the verification is accomplished, then, at logic step 128, the meter is set to its posting or general operational mode. If, at logic step 116, an access code combination for the re-initialization operation has been entered and approved by any suitable process, such as, illustrated in U.S. Pat. No. 3,792,446 to McFiggans, then the meter is unlocked, at logic step 117, and is then placed in a mode to perform a register set operation and create a new REINIT record at logic step 118 . At the time the record header is overwritten to a "Register Set" entry.

Next, at logic step 119 the entries of the new record are entered. The Delta AR since previous log entry would be updated to reflect the change in the AR since the previous record. The meter is locked at logic step 120 and a check and verification is performed at logic step 122. If verified, the meter is placed in a posting mode at logic step 128. If at logic step 122, the verification is unsuccessful, the meter is locked up, at logic step 126, and will not operate.

When the meter is locked, the "Lock" entry overwrites the Register Set entry in the record header. If a lock operation is performed immediately after the meter is parameterized, without an intervening "Set Registers" operation, as part of the locking process, the record header entry is overwritten with a lock entry after the appropriate AR, DR and PC offset value has been written to the record. The PC offset value is calculated to yield the correct "reported" PC, that is, the piece count representative of the number of meter position operations since last initialization based on the current universal PC (UPC) less the PC offset value. The meter, following this operation, will return to the meter power-up at logic step 100.

The REINIT table can accommodate six records which provide a permanent record of the register values at the time of unlock operation. If one attempted an unauthorized entry of the meter in the field in order to fraudulently reset the registers, a record of this operation would be in the REINIT table, as would any record of any modification of the registers. If the registers were modified, the amount of postage that was fraudulently issued can be determined by observing the "Delta AR" entry, plus the difference between the current AP/DR and the AR/DR at the time the registers were last reset and comparing to the records maintained by the manufacturer based upon information obtained when an authorized access code was last requested. A sufficiently knowledgeable user might attempt to return the meter to "original" status by unlocking the meter and then destroying the REINIT table. To prevent this, the meter would refuse to allow externally-requested writes to any locked recorder, unless the Manufacturing Mode jumper was installed. Utilization of the Manufacturing Mode Jumper requires the meter to be physically opened, leaving evidence of tampering. If the meter observes that either copy of the REINIT table is not valid at logic step 122, it will assume that it has been initialized. In this circumstance, the checks would be performed on each entry in both memory devices as part of the verification.

The afore description illustrates the preferred embodiment of the present invention and should not be viewed as limiting. The scope of the invention is defined by the appendix claims.

What is claimed is:

1. An improved electronic meter for accounting for funding and transaction information having:

a micro control system for controlling the operation of said meter in response to an operation program, said micro control system having a microprocessor in bus communication with a plurality of addressable memory units and first input means in bus communication with said microprocessor, said meter having a first mode of operation for performing transactions and accounting for said transactions by generating accounting information and storing said accounting information in said memory units and a second mode of operation for accessing said accounting information in response to a first security code, and said improved meter comprising:

a first one of said memory units having a plurality of accounting registers for storing said accounting information to provide a historical record of desired frequency of desired accounting information in predetermined categories, said meter having a third mode of operation for accessing said registers of said first memory and initializing said registers in response to input of a second security code, said accounting information including a REINIT table for creating a selected number of records representative of said accounting information of said accounting register in said respective categories upon each initialization of said accounting registers, said operation program having means for preventing said record from being overwritten once said respective record has been created and said meter is in said first, second or third mode.

2. An improved meter as claimed in claim 1 wherein said meter includes printing means for printing of a postage indicia representing a transaction.

3. An improved meter as claimed in claim 2 further comprising said micro control system being enclosed in a secure housing, said meter having a fourth mode of operation, and second input means within said secure housing for placing said meter in said fourth mode of operation requiring breach of said secure housing in order to access said second input means wherein said REINIT may be reinitialized only when said meter is in said fourth mode.

4. An improved electronic meter for accounting for funding and transaction information having:

a micro control system for controlling the operation of said meter in response to an operation program, said micro control system having a microprocessor in bus communication with a plurality of addressable memory units and first input means in bus communication with said microprocessor, said meter having a first mode of operation for performing transactions and accounting for said transactions by generating accounting information and storing said accounting information in said memory units and a second mode of operation for accessing said accounting information in response to a first security code, and said improved meter comprising:

a plurality of said first memory units, each of said first memory units having a plurality of accounting registers for storing said accounting information to provide a historical record of desired frequency of desired accounting information in predetermined categories such that said accounting registers are redundantly maintained in said respective first memory units, said meter having a third mode of operation for accessing said registers of said first memory units and initializing said registers in response to input of a second security code, said accounting information including a REINIT table for creating a selected number of record representative of said accounting information of said accounting register in said respective categories upon each initialization of said accounting registers, said operation program having means for preventing said record of said REINIT table from being overwritten once said respective record has been created and said meter is in said first, second or third mode.

5. An improved meter as claimed in claim 4 further comprising said micro control system being enclosed in a secure housing, said meter having a fourth mode of operation, and second input means within said secure housing for placing said meter in said fourth mode of operation requiring breach of said secure housing in order to access said second input means wherein said REINIT table may be reinitialized only when said meter is in said fourth mode.

6. An improved meter as claimed in claim 5 wherein each of said records of said REINIT table is comprised of:

a record header, an identifier of the date and time of said record creation, new register settings, change in selected register setting from pre-initialization and new register settings of selected registers, and means for comparing said record in each of said first memory units and indentifying a true comparison.

* * * * *

UNITED STATES PATENT AND TRADEMARK OFFICE

CERTIFICATE OF CORRECTION

PATENT NO. : 5,572,429

DATED : November 5, 1996

INVENTOR(S) : Kevin D. Hunter, et al.

It is certified that error appears in the above-indentified patent and that said Letters Patent is hereby corrected as shown below:

Column 1 line 1 delete "SYSTEM FOR RECORDING THE INITIALIZATION AND RE-INITIALIZATION OF AN ELECTRONIC POSTAGE METER" and insert --A SYSTEM FOR RECORDING THE INITIALIZATION AND RE-INITIALIZATION OF AN ELECTRONIC POSTAGE METER--.

Column 3 line 47 after "housing" insert --13--.

Column 5 line 8 delete "Next, at" and insert --At--.

Signed and Sealed this

Tenth Day of June, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,572,429

DATED : November 5, 1996

INVENTOR(S) : Kevin D. Hunter, et al.

It is certified that error appears in the above-indentified patent and that said Letters Patent is hereby corrected as shown below:

Cover Page: Add item [73] Assignee: Pitney Bowes Inc.
Stamford, Connecticut

Signed and Sealed this

Twenty-sixth Day of August, 1997

*Attest:*

Bruce Lehman

BRUCE LEHMAN

*Attesting Officer*

*Commissioner of Patents and Trademarks*